US005642429A

United States Patent [19]

Janssen

[11] Patent Number: 5,642,429

[45] Date of Patent: Jun. 24, 1997

[54] SOUND REPRODUCTION SYSTEM HAVING ENHANCED LOW FREQUENCY DIRECTIONAL CONTROL CHARACTERISTICS

[76] Inventor: Craig N. Janssen, 16400 Ledgemont La., #102, Dallas, Tex. 75248

[21] Appl. No.: 431,039

[22] Filed: Apr. 28, 1995

[51] Int. Cl.[6] ..... H04R 25/00

[52] U.S. Cl. ..... 381/182; 381/24; 381/97; 381/99

[58] Field of Search ..... 381/182, 24, 87, 381/88, 89, 90, 98, 99, 97

[56] References Cited

U.S. PATENT DOCUMENTS

| | | | |
|---|---|---|---|
| 3,138,667 | 6/1964 | Avedon | 381/90 |
| 3,947,635 | 3/1976 | Frankman | 381/24 |
| 4,771,466 | 9/1988 | Modafferi | 381/99 |
| 4,845,759 | 7/1989 | Danley | 381/97 |
| 5,233,664 | 8/1993 | Yanagawa et al. | 381/97 |

FOREIGN PATENT DOCUMENTS

| | | | |
|---|---|---|---|
| 0978781 | 12/1964 | United Kingdom | 381/24 |

*Primary Examiner*—Curtis Kuntz
*Assistant Examiner*—Duc Nguyen
*Attorney, Agent, or Firm*—Harris, Tucker & Hardin, P.C.

[57] ABSTRACT

A sound reproduction system includes a plurality of loudspeakers arranged in a spaced array which extends onto opposite sides of a center point. The spaced array includes a first pair of loudspeakers equally spaced apart from the center point and disposed at opposite ends of the array and a second pair of loudspeakers spaced inwardly from the first pair and also positioned on opposite sides of and equally spaced from the center point. The sound reproduction system further includes a low-pass filter having an input coupled to an output of a signal generator and an output coupled to an input of each one of the first pair of loudspeakers and a first band-pass filter having an input coupled to the output of the signal generator and an output coupled to an input of each one of the second pair of loudspeakers. The sound reproduction system may further include a third pair of loudspeakers spaced inwardly from the second pair of loudspeakers and positioned on opposite sides of and equally spaced from the center point and a second band-pass filter having an input coupled to the output of the signal generator and an output coupled to an input of each one of the third pair of loudspeakers.

40 Claims, 3 Drawing Sheets

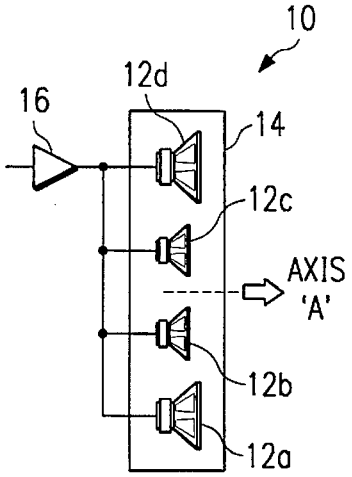
FIG. 1A
(PRIOR ART)
FIG. 1B
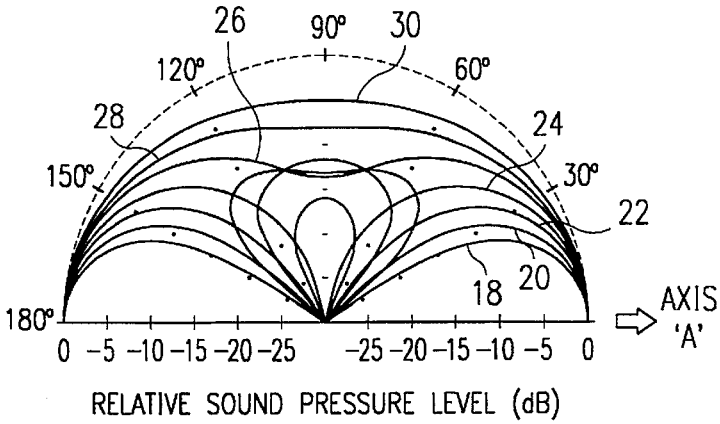
FIG. 2A
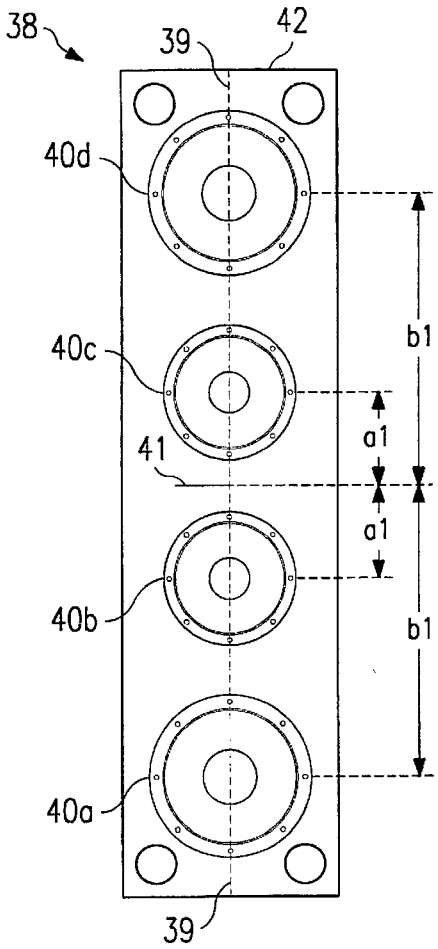
FIG. 1C
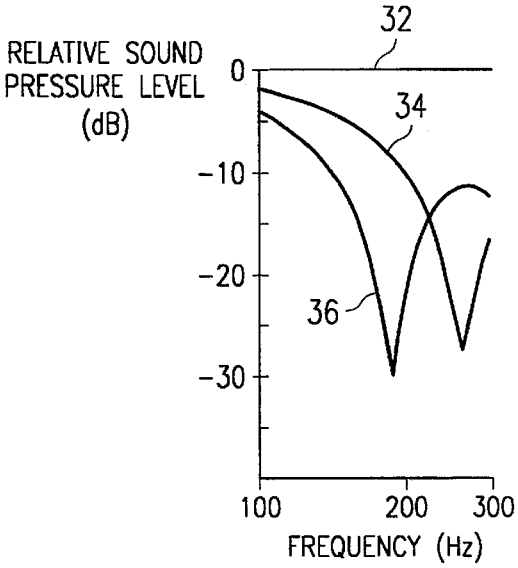

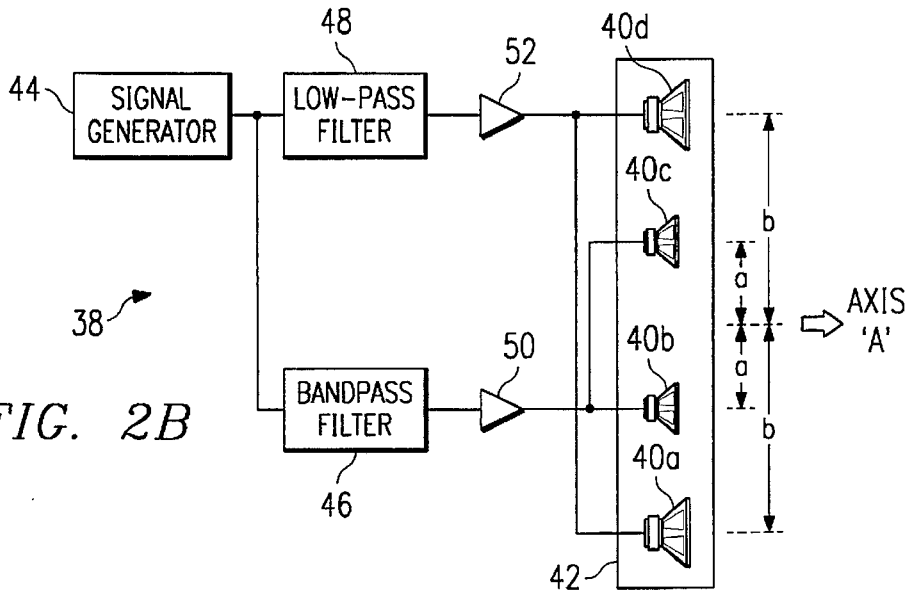
FIG. 2B
FIG. 2C
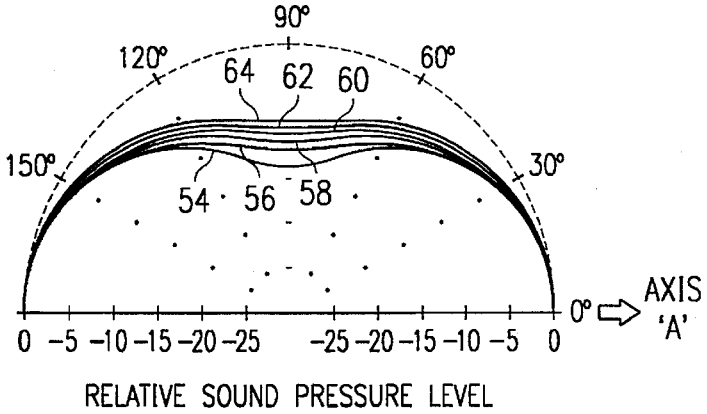
FIG. 2D
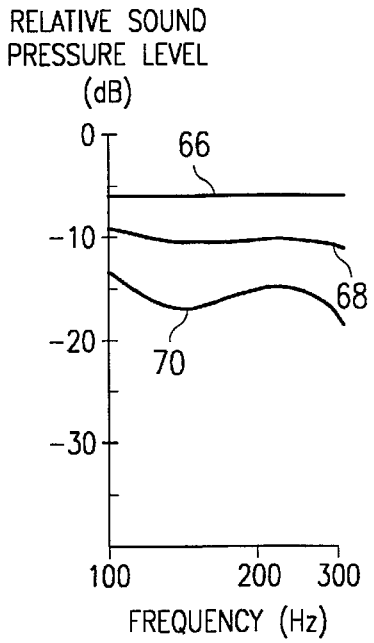
FIG. 2E
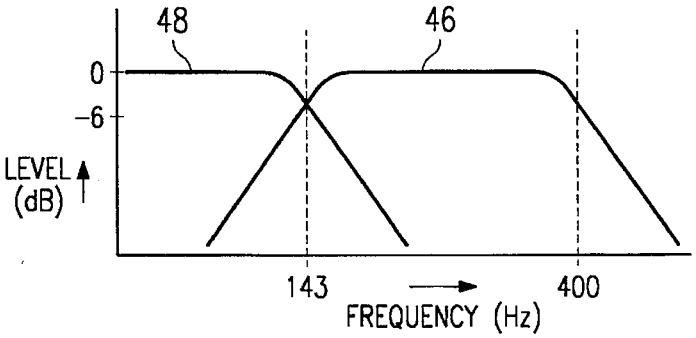

SOUND REPRODUCTION SYSTEM HAVING ENHANCED LOW FREQUENCY DIRECTIONAL CONTROL CHARACTERISTICS

BACKGROUND OF THE INVENTION

1. Field of the Invention

The present invention generally relates to a sound reproduction system having enhanced directional control at low frequencies and, more particularly, to a sound reproduction system characterized by reduced off-axis sound levels.

2. Description of Related Art

Sound is a physical disturbance in the medium through which it propagates. For example, in air, sound consists of localized variations in pressure above and below normal atmospheric pressure. Accordingly, the vast majority of sound reproduction systems are comprised of electromagnetic transducers whereby an electrical signal is transformed into a mechanical vibration which, in turn, is transformed into an acoustic signal. Loudspeakers commonly included in such a sound reproduction system are typically comprised of a diaphragm, most commonly, a cone, a support system in which the cone diaphragm is mounted and a drive coil which vibrates the cone diaphragm in a desired fashion to produce sound waves.

While sound reproduction systems have been the subject of numerous innovations over the years, pattern control of sound projection within an auditorium or other listening area has remained a problem. For example, it would be desirable if sound levels produced by a sound reproduction system installed in an auditorium could be the same for all listeners, regardless of their location in the auditorium. One obstacle to achieving such a system is that, in general, the distance separating listeners from the sound reproduction system tends to vary dramatically based upon the listener's position within the auditorium. In many auditoriums, the distance from the sound reproduction system to the nearest listener is about 25–35 feet, the distance to a listener located in an extreme side seat is about 50–70 feet while the distance to the most distant listener is about 80–120 feet. Thus, as sound levels tend to drop-off as distance from the sound reproduction system is increased, sound level distribution within the auditorium seating tends to be uneven.

Another obstacle to achieving such a sound reproduction system is that sound reproduction systems tend to lack sufficient pattern control, particularly when generating low frequency sounds. By the term "low frequency", it is intended to refer to frequencies where the wavelength $\delta$ of the sound wave is large compared to the diameter of the cone of the loudspeaker(s) generating the sound wave, i.e., typically frequencies lower than 1500 Hz. At such low frequencies, when multiple low frequency devices are used, the directional characteristics, i.e., the amount of drop-off in sound levels, of sound waves tend to vary dramatically based upon the off-axis angle of the listener. Furthermore, the directional characteristics at any given off-axis angle tend to shift based upon the particular frequency of the sound wave. Thus, the amount of compensation required to compensate for off-angle drop-offs in sound levels will tend to vary based upon the frequency of the sound being generated.

Referring now to FIG. 1, a conventional sound reproduction system 10 characterized by poor pattern control at low frequencies will now be described in greater detail. The sound reproduction system 10 includes a plurality of loudspeakers, each having a cone diaphragm, mounted in a support structure 14. For example, the sound reproduction system 10 may include first, second, third and fourth loudspeakers 12*a*, 12*b*, 12*c* and 12*d*. The loudspeakers 12*a–d* are arranged in a vertical array, i.e., the general center of each loudspeaker 12*a–d* is located along a vertical axis and spaced a selected distance from a central axis "A" which is generally orthogonal to the vertical axis and extends outwardly from the front side surface of the support structure 14.

A single amplifier 16 is connected to the electrical input side of each one of the loudspeakers 12*a–d*. As is conventional in the art, a signal generator (not shown) transmits an electrical input to the amplifier 16 which, in turn, provides an amplified electrical signal to each of the loudspeakers 12*a–d* where the amplified electrical signal is converted into an acoustic signal and propagated into an auditorium or other listening area.

Referring next to FIG. 1B, a polar response plot which illustrates directional characteristics of sound generated by the sound reproduction system 10 may now be seen. More specifically, line 18 illustrates the directional characteristics of sound generated by the sound reproduction system 10 at a frequency of 110 Hz, line 20 illustrates the directional characteristics of sound generated by the sound reproduction system 10 at 130 Hz, line 22 illustrates the directional characteristics of sound generated by the sound reproduction system 10 at 155 Hz, line 24 illustrates the directional characteristics of sound generated by the sound reproduction system 10 at 220 Hz, line 26 illustrates the directional characteristics of sound generated by the sound reproduction system 10 at 261 Hz and line 28 illustrates the directional characteristics of sound generated by the sound reproduction system 10 at 311 Hz.

As illustrated in FIG. 1B, while the amount of sound drop-off which occurs on-axis, i.e., along the axis "A" is negligible, for very low frequencies, significant drop-offs in sound levels can occur only 30 degrees off-axis. At higher frequencies, however, off-axis drop-off is of less concern. For example, at f=110 Hz, the sound level will go 20 dB down at 30 degrees off-axis while, at f=311 Hz, the sound level will only go down about 6 dB. Furthermore, at frequencies below 185 Hz, the drop-off begins to lobe, thereby producing a very irregular drop-off pattern characterized by very dramatic drop-offs at specific angle for the various frequencies. For example, a very sudden drop-off occurs at 90 degrees off-angle for f=185 Hz.

Referring next to FIG. 1C, a level plot which illustrates the drop-off in sound level at particular angles will now be described in greater detail. More specifically, line 32 illustrates that, for frequencies under f=300 Hz, negligible drop-off occurs on-axis. In contrast, however, line 34 illustrates that, for 45 degrees off-angle, a 30 dB drop-off will occur at about 275 Hz while line 36 illustrates that, for 90 degrees off-angle, the 30 dB drop-off will occur at about 195 Hz.

Prior attempts at improving pattern control for low frequency sounds have been directed towards the design of complicated sound reproduction systems intended to achieve even sound levels by selectively adding or canceling. Often, such systems include a sophisticated computer processing system to selectively adjust sound levels generated by various loudspeakers included in the sound reproduction system. Typically, such sound reproduction systems are custom built for a particular auditorium and have remained quite expensive to design and build.

It can be readily seen from the foregoing that it would be desirable to provide a simple, low cost sound reproduction system which achieves improved pattern control at low frequencies. It is, therefore, the object of this invention to provide such a sound reproduction system.

SUMMARY OF THE INVENTION

In a first embodiment, the present invention is of a sound reproduction system which includes a plurality of loudspeakers arranged in a spaced array which extends onto opposite sides of a center point. The spaced array includes a first pair of loudspeakers equally spaced apart from the center point and disposed at opposite ends of the array and a second pair of loudspeakers spaced inwardly from the first pair and also positioned on opposite sides of and equally spaced from the center point. The sound reproduction system further includes a low-pass filter having an input coupled to an output of a signal generator and an output coupled to an input of each one of the first pair of loudspeakers and a first band-pass filter having an input coupled to the output of the signal generator and an output coupled to an input of each one of the second pair of loudspeakers. Preferably, the sound reproduction system also includes a support structure for supportably mounting the plurality of loudspeakers in the spaced array.

In further aspects thereof, the low-pass filter is configured to have a high end 6 dB drop-off at about 143 Hz and/or the first band-pass filter is configured to have a low end 6 dB drop-off at about 143 Hz. In still further aspects thereof, the spaced array is essentially straight, the ratio of the distance separating one of the first pairs of loudspeakers from the center point to the distance separating one of the second pairs of loudspeakers from the center point is about 3:1, each one of the first pair of loudspeakers may be spaced approximately 2.25 feet from the center point and each one of the second pair of loudspeakers may be spaced approximately 0.75 feet from the center point.

In another aspect of this embodiment of the invention, the sound reproduction further includes a third pair of loudspeakers spaced inwardly from the second pair of loudspeakers and positioned on opposite sides of and equally spaced from the center point and a second band-pass filter having an input coupled to the output of the signal generator and an output coupled to an input of each one of the third pair of loudspeakers. Preferably, the sound reproduction system also includes a support structure for supportably mounting the plurality of loudspeakers in the spaced array.

In further aspects thereof, the first band-pass filter is configured to have a low end 6 dB drop-off at about 287 Hz, the second band-pass filter is configured to have a high end 6 dB drop-off at about 287 Hz and a low end 6 dB drop-off at about 96 Hz and the low-pass filter is configured to have a high end 6 dB drop-off at about 96 Hz.

In another embodiment, the present invention is of a sound reproduction system which includes a plurality of loudspeakers arranged in a spaced array which extends onto opposite sides of a center point. The spaced array includes an outermost pair of loudspeakers disposed at opposite ends of the array and at least one inner pair of loudspeakers spaced inwardly from the outward pair of loudspeakers and positioned on opposite sides of the center point. Each loudspeaker included in the outermost pair of loudspeakers is equally spaced apart from the center point. Similarly, each loudspeaker included in one of the at least one inner pairs of loudspeakers are also equally spaced apart from the center point. The sound reproduction system further includes a low-pass filter and a band-pass filter corresponding to each one of the at least one inner pair of loudspeakers. The low-pass filter has an output coupled to an input of each one of the outer pair of loudspeakers while each of the band-pass filters has an output coupled to an input of each one of the corresponding inner pair of loudspeakers.

In one particular aspect thereof, the sound reproduction system includes a first inner pair of loudspeakers, each spaced a first distance from the center point, and a first band-pass filter having an output coupled to an input of each one of the first inner pair of loudspeakers. Preferably, the low-pass filter has a high end frequency limit approximately equal to a low end frequency limit of the first band-pass filter. In another particular aspect thereof, the sound reproduction system further includes a second inner pair of loudspeakers, each spaced a second distance, smaller than the first distance, from the center point and a second band-pass filter having an output coupled to an input of each one of the second inner pair of loudspeakers. Preferably, the first band-pass filter has a low end frequency limit approximately equal to a high end frequency limit of the low-pass filter and a high end frequency limit approximately equal to a low end frequency limit of the second band-pass filter. In another, more particular, aspect thereof, the spaced array is an essentially straight spaced array which, in alternate further aspects thereof, may be orientated along a generally vertical axis, a generally horizontal axis or a generally diagonal axis.

BRIEF DESCRIPTION OF THE DRAWING

The present invention may be better understood, and its numerous objects, features and advantages will become apparent to those skilled in the art by reference to the accompanying drawing, in which:

FIG. 1A is a block diagram of a conventional loudspeaker commonly incorporated as part of a sound reproduction system;

FIG. 1B is a polar response plot which illustrates directional characteristics of sound generated by the loudspeaker illustrated in FIG. 1A at selected frequencies;

FIG. 1C is a level plot which illustrates sound level drop-offs at various frequencies for sound generated by the loudspeaker illustrated in FIG. 1A in selected directions;

FIG. 2A is a front view of a first embodiment of a sound reproduction system constructed in accordance with the teachings of the present invention and characterized by enhanced directional control during the reproduction of low frequency sound;

FIG. 2B is a block diagram of the sound reproduction system of FIG. 2A;

FIG. 2C is a polar response plot which illustrates the enhanced directional characteristics of sound generated by the sound reproduction system of FIGS. 2A–B;

FIG. 2D is a level plot which illustrates the reductions in sound level drop-offs for sound generated by the sound reproduction system of FIGS. 2A–B;

FIG. 2E is a graphical illustration of the filter characteristics for the band-pass and low-pass filters of the sound reproduction system of FIGS. 2A–B;

DETAILED DESCRIPTION

Figure 3A:
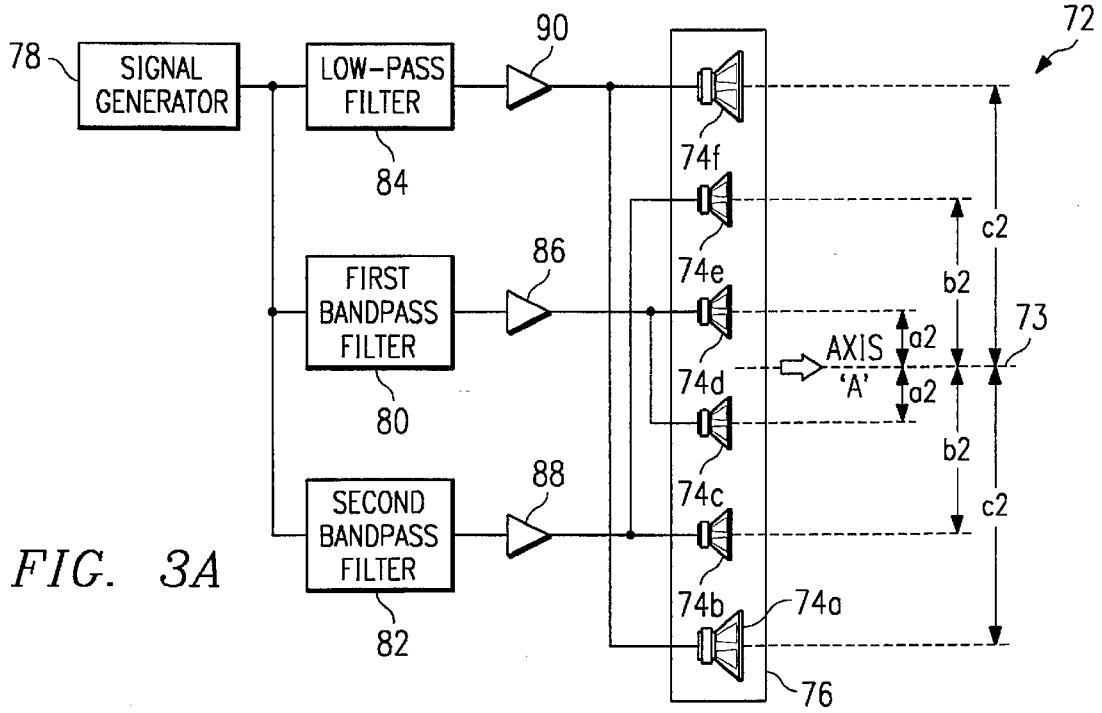
FIG. 3A is a block diagram of a second, alternate embodiment of the enhanced directional control sound reproduction system of FIG. 2A.

Turning now to FIGS. 2A–B, an improved sound reproduction system 38 constructed in accordance with the teachings of the present invention, thereby achieving improved pattern control by eliminating the dramatic drop-offs in sound level which characterize prior sound reproduction systems will now be described in greater detail. The sound reproduction system 38 includes first, second, third and fourth loudspeakers 40*a*, 40*b*, 40*c* and 40*d*, each having a cone diaphragm, mounted in a support structure 42. The loudspeakers 40*a–d* are arranged as an array, i.e., the general center of each loudspeaker 40*a–d* is located along axis 39. As illustrated herein, the loudspeakers 40*a–d* are arranged in a vertical array, i.e., the general center of each loudspeaker 12*a–d* is located along a vertical axis. It should be noted, however, that while the illustrated embodiment discloses four loudspeakers arranged in a vertical array, it is specifically contemplated that the invention may encompass any sound reproduction system which includes any greater even number of loudspeakers arranged along a single axis orientated in any direction.

The loudspeakers 40*a–d* of the sound reproduction system 38 are arranged in loudspeaker pairs. More specifically, the loudspeakers 40*b* and 40*c* form an inner loudspeaker pair, the general center of each of which is spaced, along the vertical axis 39, a first distance "a1" from center line 41 while the loudspeakers 40*a* and 40*d* form an outer loudspeaker pair, the general center of each of which is spaced, along the vertical axis 39, a second distance "b1" from the center line 41. In accordance with the teachings of the present invention, the ratio of the second distance b1 to the first distance a1 is 3:1. Thus, in the example disclosed herein, the center of each loudspeaker 40*b*, 40*c* of the inner loudspeaker pair is spaced 0.75 feet from the center line 41 while the center of each loudspeaker 40*a*, 40*d* of the outer loudspeaker pair is spaced 2.25 feet from the center line 41. It should be noted, however, that these distances are merely exemplary and that various other separation distances are suitable for use with the present invention.

To generate a desired sound, a signal generator 44 produces a corresponding electrical signal for output to a band-pass filter 46 and to a low-pass filter 48. As will be more fully described below, both the band-pass filter 46 and the low-pass filter 48 are fourth order Linkwitz-Riley filters configured to reject electrical signals from the signal generator 44 which are outside of a selected frequency range. The output of the band-pass filter 46 is provided to an amplifier 50 which amplifies the first filtered electrical signal before propagating the first amplified signal to each one of the inner pair of loudspeakers 40*b*, 40*c* for conversion into a first audible acoustic signal which propagates into an auditorium or other listening area while the output of the low-pass filter 48 is provided to an amplifier 52 which amplifies the second filtered electrical signal before propagating the second amplified signal to each one of the outer pair of loudspeakers 40*a*, 40*d* for conversion into a second acoustic signal which also propagates into the auditorium or other listening area.

Referring next to FIG. 2C, a polar response plot which illustrates the improved directional characteristics of sound generated by the sound reproduction system 38 may now be seen. More specifically, line 54 illustrates the directional characteristics of sound generated by the sound reproduction system 38 at a frequency of 110 Hz, line 56 illustrates the directional characteristics of sound generated by the sound reproduction system 38 at 130 Hz, line 58 illustrates the directional characteristics of sound generated by the sound reproduction system 38 at 155 Hz, line 60 illustrates the directional characteristics of sound generated by the sound reproduction system 38 at 220 Hz, line 62 illustrates the directional characteristics of sound generated by the sound reproduction system 38 at 261 Hz and line 64 illustrates the directional characteristics of sound generated by the sound reproduction system 38 at 311 Hz.

As before, the amount of sound level drop-off which occurs on-axis, i.e., along axis "A" is negligible. However, the extent to which low frequency sound levels drop-off at off-axis angles, as well as the variation in sound level drop-off as a function of frequency, has been substantially reduced. For example, the maximum drop-off for the sound reproduction system 38 is a 13 dB drop-off which occurs at 90 degrees off-angle for f=110 Hz. In comparison, at f=110 Hz, the sound reproduction system 10 would experience a 30 dB drop-off at approximately 45 degrees off-angle. Furthermore, for the sound reproduction system 38, the maximum variation in drop-off, as a function of frequency is 8 dB down at 90 degrees off-angle with the variation in drop-off being less than 5 dB down between 0–60 and 120–180 degrees off-angle. In comparison, the sound reproduction system 10 repeatedly exhibited drop-off variations of 25 dB or more.

Referring next to FIG. 2D, a level plot which illustrates the significant reduction in sound level drop-off, as a function of frequency, achieved by the sound reproduction system 38 will now be described in greater detail. As may now be seen, line 66 illustrates that, for frequencies under f=300 Hz, about a 6 dB drop-off occurs on axis, i.e., along axis "A". In contrast, however, line 68 illustrates that, for 45 degrees off-angle, the drop-off remains constant at around 10 dB while line 70 illustrates that, for 90 degrees off-angle, the drop-off will oscillate between about 13 and 18 dB. Again, this compares quite favorably to the sound reproduction system 10 where, for a selected off-axis angle, the drop-off would fluctuate significantly in response to a change in frequency.

Referring next to FIG. 2E, the characteristics of the band-pass filter 46 and low-pass filter 48 which, when respectively coupled to the inner and outer pairs of the loudspeakers 40*b* and 40*c*, 40*a* and 40*d*, achieve the above-described improvement in pattern control, will now be described in greater detail. As previously stated, both the band-pass filter 46 and the low-pass filter 48 are fourth order Linkwitz-Riley filters set to reject selected frequencies. More specifically, the cross-over frequency for the band-pass filter 46 and the low-pass filter may be calculated using the relationship:

CROSS-OVER FREQUENCY (Hz)=215/DISTANCE (Feet) where the distance is the separation between the inner pair of loudspeakers of the two pairs of loudspeakers coupled to the respective filters for which the cross-over frequency is to be determined. Thus, for the example disclosed herein, the cross-over frequency for the band-pass filter 46 and the low-pass filter 48 is 215/1.50, or about 143 Hz. Accordingly, the fourth order Linkwitz-Riley filter utilized as the band-pass filter 46 is set to have a low end 6 dB drop-off at 143 Hz and a high end 6 dB drop-off outside of the low frequency range, for example, 400 Hz, while the fourth order Linkwitz-Riley filter utilized as the low-pass filter 48 is set to have a high end 6 dB drop-off at 143 Hz.

Turning now to FIG. 3A, an alternate embodiment of the sound reproduction system having enhanced low frequency direction control characteristics subject of the present invention will now be described in greater detail. As may now be seen, a sound reproduction system 72 includes first, second, third, fourth, fifth and sixth loudspeakers 74*a*, 74*b*, 74*c*, 74*d*, 74*e* and 74*f*, each having a cone diaphragm, mounted in a support structure 76. The loudspeakers 74*a–f* are arranged as an array, i.e., the general center of each loudspeaker 74*a–f* is located along a central vertical axis (not visible in FIG. 3A but positioned similarly to axis 39 of FIG. 2A. Thus, like the loudspeakers 40*a–d*, the loudspeakers 74*a–f* are arranged in a vertical array, i.e., the general center of each loudspeaker 12*a–d* is located along the vertical axis. Again, it should be clearly understood that, while the illustrated embodiment discloses is again arranged in a vertical array, it is specifically contemplated that the invention encompass sound reproduction system having at least one loudspeaker array arranged along a single axis orientated in any direction.

The loudspeakers 74*a–f* of the sound reproduction system 38 are arranged in loudspeaker pairs. More specifically, the loudspeakers 74*c* and 74*d* form an innermost loudspeaker pair, the general center of each of which is spaced, along the vertical axis, a first distance "a2" from center line 73, the loudspeakers 74*b* and 74*e* form an inner loudspeaker pair, the general center of each of which is spaced, along the vertical axis, a second distance "b2" from the center line 73 and the loudspeakers 74*a* and 74*f* form an outer loudspeaker pair, the general center of each of which is spaced, along the vertical axis, a third distance "c2" from the center line 73. In accordance with the teachings of the present invention, the ratio of the second distance b2 to the first distance a2 is 3:1 and the ratio of the third distance c2 to the second distance b2 is also 3:1. Thus, in the example disclosed herein, the center of each loudspeaker 74*c*, 74*d* of the innermost loudspeaker pair is spaced 0.375 feet from the center line 73 while the center of each loudspeaker 74*b*, 74*e* of the inner loudspeaker pair 74*b*, 74*e* is spaced 1.125 feet from the center line 73 and the center of each loudspeaker 74*a*, 74*f* of the outer loudspeaker pair is spaced 3.375 feet from the center line 73. Again, it should be noted that these distances are merely exemplary and that various other separation distances are suitable for use with the present invention.

To generate a desired sound, a signal generator 78 produces a corresponding electrical signal for output to a first band-pass filter 80, a second band-pass filter 82 and to a low-pass filter 84. As will be more fully described below, both the first and second band-pass filters 80 and 82, as well as the low-pass filter 84 are fourth order Linkwitz-Riley filters configured to reject electrical signals from the signal generator 44 which are outside of respective selected frequency ranges. The output of the first band-pass filter 80 is provided to an amplifier 86 which amplifies the first filtered electrical signal before propagating the first amplified signal to each one of the innermost pair of loudspeakers 74*c*, 74*d* for conversion into a first audible acoustic signal which propagates into an auditorium or other listening area while the output of the second band-pass filter 82 is provided to an amplifier 88 which amplifies the second filtered electrical signal before propagating the second amplified electrical signal to each one of the inner pair of loudspeakers 74*b*, 74*e* for conversion into a second audible acoustic signal which propagates into the auditorium or other listening area. Finally, the output of the low-pass filter 84 is provided to an amplifier 90 which amplifies the third filtered electrical signal before propagating the third amplified signal to each one of the outer pair of loudspeakers 74*a*, 74*f* for conversion into a third acoustic signal which also propagates into the auditorium or other listening area.

Figure 3B:
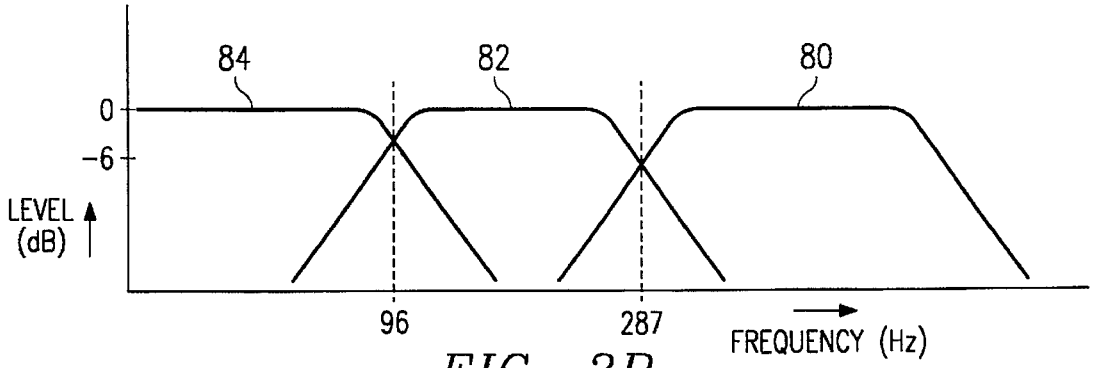
FIG. 3B is a graphical illustration of the filter characteristics for the band-pass and low-pass filters of the sound reproduction system of FIG. 3A.

Referring next to FIG. 3B, the characteristics of the first band-pass filter 80, the second band-pass filter 82 and the low-pass filter 84 which, when respectively coupled to the innermost, inner and outer pairs of the loudspeakers 74*c* and 94*d*, 74*b* and 74*e*, 74*a* and 74*f*, again achieve the above-described improvement in pattern control, will now be described in greater detail. As previously stated, both the first band-pass filter 80, the second band-pass filter 82 and the low-pass filter 84 are fourth order Linkwitz-Riley filters set to reject selected frequencies. More specifically, using the previously described relationship between the cross-over frequency for first and second filters and the distance separating the inner pair of loudspeakers of the two pair of loudspeakers coupled to the respective filters for which the cross-over frequency is to be determined, the cross-over frequency for the first band-pass filter 80 and the second band-pass filter 82 is 215/0.75, or about 287 Hz and the cross-over frequency for the second band-pass filter 82 and the low-pass filter 84 is 215/2.25, or about 96 Hz. Accordingly, the fourth order Linkwitz-Riley filter utilized as the first band-pass filter 80 is set to have a low end 6 dB drop-off at 287 Hz and a high end 6 dB drop-off outside of the low frequency range, for example 400 Hz, the fourth order Linkwitz-Riley filter utilized as the second band-pass filter 82 is set to have a low end 6 dB drop-off at 96 Hz and a high end 6 dB drop-off at 287 Hz and the fourth order Linkwitz-Riley filter utilized as the low-pass filter 84 is set to have a high end 6 dB drop-off at 96 Hz.

Figure 4A:
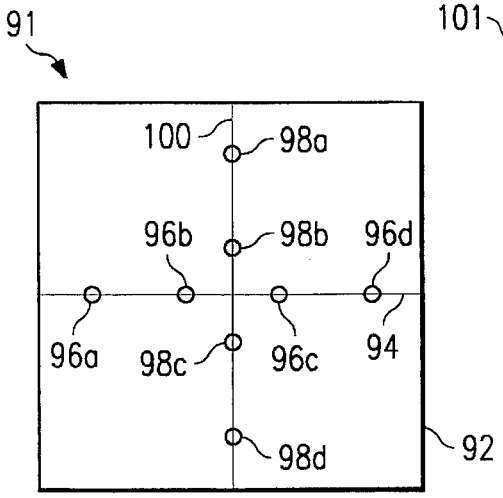
FIG. 4A is a front view of an alternate embodiment of the sound reproduction system of FIG. 2A configured for enhanced multiple axes directional control.
Figure 4B:
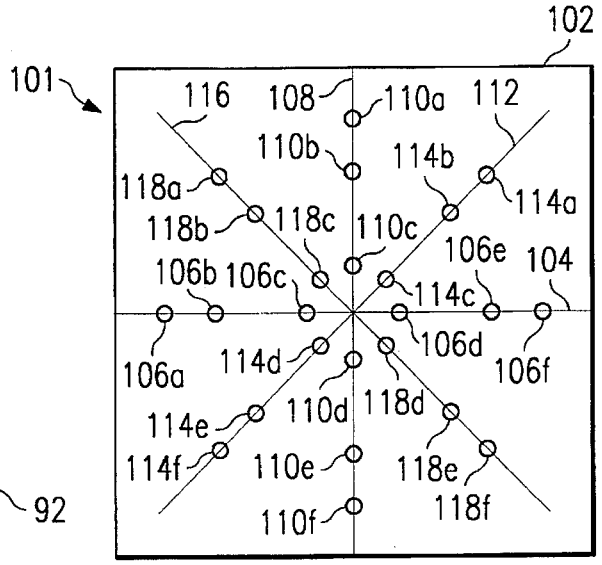
FIG. 4B is a front view of an alternate embodiment of the sound reproduction system of FIG. 3A configured for enhanced multiple axes directional control.

Turning now to FIGS. 4A–B, sound reproduction systems having plural loudspeaker arrays, each arranged along a distinct axis, will now be described in greater detail. In FIG. 4A, a sound reproduction system 91 having a vertical and horizontal loudspeaker arrays is shown. More specifically the horizontal loudspeaker array is comprised of first, second, third and fourth loudspeakers 96*a*, 96*b*, 96*c* and 96*d* positioned within support structure 92 along horizontal axis 94 while the vertical loudspeaker array is comprised of first, second, third and fourth loudspeakers 98*a*, 98*b*, 98*c* and 98*d* positioned within the support structure 92 along vertical axis 100. For the horizontal array, the electrical inputs to the loudspeakers 96*b* and 96*c* are connected to form an inner pair of loudspeakers while the electrical inputs to the loudspeakers 96*a* and 96*d* are connected to form an outer pair of loudspeakers. Similarly, for the vertical array, the electrical inputs to the loudspeakers 98*b* and 98*c* are connected to form an inner pair of loudspeakers while the electrical inputs to the loudspeakers 98*a* and 98*d* are connected to form an outer pair of loudspeakers. While not visible in FIG. 4A, the electrical inputs for the outer loudspeaker pairs, i.e., the loudspeakers 96*a*, 96*d*, 98*a* and 98*d*, are coupled to the output of a low-pass filter similar to the low-pass filter 48 while the electrical inputs for the inner loudspeaker pairs, i.e. the loudspeakers 96*b*, 96*c*, 98*b* and 98*c*, are coupled to the output of a band-pass filter similar to the band-bass filter 46.

In FIG. 4B, a sound reproduction system 101 having vertical, horizontal and first and second diagonal loudspeaker arrays is shown. More specifically, the horizontal loudspeaker array is comprised of first, second, third, fourth, fifth and sixth loudspeakers 106*a*, 106*b*, 106*c*, 106*d*, 106*e* and 106*f* positioned within support structure 102 along horizontal axis 109, the vertical loudspeaker array is comprised of first, second, third, fourth, fifth and sixth loudspeakers 110*a*, 110*b*, 110*c*, 110*d*, 110*e* and 110*f* positioned within the support structure 102 along vertical axis 108, the first diagonal loudspeaker array is comprised of first, second, third, fourth, fifth and sixth loudspeakers 114*a*, 114*b*, 114*c*, 114*d*, 114*e* and 114*f* positioned within support structure 102 along first vertical axis 112 and the second diagonal loudspeaker array is comprised of first, second, third, fourth, fifth and sixth loudspeakers 118*a*, 118*b*, 118*c*, 118*d*, 118*e* and 118*f* positioned within the support structure 102 along second diagonal axis 116.

For the horizontal array, the electrical inputs to the loudspeakers 106*c* and 106*d* are connected to form an innermost pair of loudspeakers, the electrical inputs to the loudspeakers 106*b* and 106*e* are connected to form an inner pair of loudspeakers and the electrical inputs to the loudspeakers 106*a* and 106*f* are connected to form an outer pair of loudspeakers. Similarly, for the vertical array, the electrical inputs to the loudspeakers 110*c* and 110*d* are connected to form an innermost pair of loudspeakers, the electrical inputs to the loudspeakers 110*b* and 110*e* are connected to form an inner pair of loudspeakers and the electrical inputs to the loudspeakers 110*a* and 110*f* are connected to form an outer pair of loudspeakers, for the first diagonal array, the electrical inputs to the loudspeakers 114*c* and 114*d* are connected to form an innermost pair of loudspeakers, the electrical inputs to the loudspeakers 114*b* and 114*e* are connected to form an inner pair of loudspeakers and the electrical inputs to the loudspeakers 114*a* and 114*f* are connected to form an outer pair of loudspeakers and, for the second diagonal array, the electrical inputs to the loudspeakers 118*c* and 118*d* are connected to form an innermost pair of loudspeakers, the electrical inputs to the loudspeakers 118*b* and 118*e* are connected to form an inner pair of loudspeakers and the electrical inputs to the loudspeakers 118*a* and 118*f* are connected to form an outer pair of loudspeakers. While not visible in FIG. 4B, the electrical inputs for the outer loudspeaker pairs, i.e., the loudspeakers 106*a*, 106*f*, 110*a*, 110*f*, 114*a*, 114*f* and 118*a* and 118*f*, are coupled to the output of a low-pass filter similar to the low-pass filter 84, the electrical inputs for the innermost loudspeaker pairs, i.e., the loudspeakers 106*c*, 106*d*, 110*c*, 110*d*, 114*c*, 114*d*, 118*c* and 118*d*, are coupled to the output of a first band-pass filter similar to the first band-pass filter 80 and the electrical inputs for the inner loudspeaker pairs, i.e., the loudspeakers 106*b*, 106*e*, 110*b*, 110*e*, 114*b*, 114*e*, 118*b* and 118*e*, are coupled to the output of a second band-pass filter similar to the second bandpass filter 82.

Thus, there has been described and illustrated herein, a sound reproduction system which achieves more uniform low frequency sound levels at off-axis angles by reducing the extent to which sound levels drop-off with respect to changes in frequency, thereby achieving a sound reproduction system characterized by enhanced directional control at low frequencies. However, those skilled in the art should recognize that many modifications and variations besides those specifically mentioned may be made in the techniques described herein without departing substantially from the concept of the present invention. Accordingly, it should be clearly understood that the form of the invention described herein is exemplary only and is not intended as a limitation on the scope of the invention.

What is claimed is:

1. A sound reproduction system, comprising:

a signal generator having an output;

a plurality of loudspeakers arranged in a spaced array on opposite sides of a center point, said spaced array including a first pair of loudspeakers disposed at opposite ends of said array and each being equally spaced apart from said center point, and a second pair of loudspeakers spaced inwardly from said first pair of loudspeakers and positioned on opposite sides of and equally spaced from said center point;

a low-pass filter having an input coupled to said output of said signal generator and an output coupled to an input of each one of said first pair of loudspeakers; and a first band-pass filter having an input coupled to said output of said signal generator and an output coupled to an input of each one of said second pair of loudspeakers.

2. A sound reproduction system according to claim 1 and further comprising a support structure for supportably mounting said plurality of loudspeakers in said spaced array.

3. A sound reproduction system according to claim 1 wherein said low-pass filter is configured to have a high end 6 dB drop-off at about 143 Hz.

4. A sound reproduction system according to claim 1 wherein said first band-pass filter is configured to have a low end 6 dB drop-off at about 143 Hz.

5. A sound reproduction system according to claim 1 wherein said low-pass filter is configured to have a high end 6 dB drop-off at about 143 Hz and said first band-pass filter is configured to have a low end 6 dB drop-off at about 143 Hz.

6. A sound reproduction system according to claim 5 wherein said spaced array is an essentially straight spaced array.

7. A sound reproduction system according to claim 6 wherein the ratio of the distance of one of said first pair of loudspeakers from said center point to the distance of one of said second pair of loudspeakers from said center point is about 3:1.

8. A sound reproduction system according to claim 6 wherein each one said first pair of loudspeakers is spaced approximately 2.25 feet from said center point.

9. A sound reproduction system according to claim 8 wherein each one of said second pair of loudspeakers is spaced approximately 0.75 feet from said center point.

10. A sound reproduction system according to claim 1 and further comprising:

a third pair of loudspeakers spaced inwardly from said first pair of loudspeakers, spaced outwardly from said second pair of loudspeakers and positioned on opposite sides of and equally spaced from said center point; and a second band-pass filter having an input coupled to said output of said signal generator and an output coupled to an input of each one of said third pair of loudspeakers.

11. A sound reproduction system according to claim 10 and further comprising a support structure for supportably mounting said plurality of loudspeakers in said spaced array.

12. A sound reproduction system according to claim 10 wherein said first band-pass filter is configured to have a low end 6 dB drop-off at about 287 Hz, said second band-pass filter is configured to have a high end 6 dB drop-off at about 287 Hz and a low end 6 dB drop-off at about 96 Hz and said low-pass filter is configured to have a high end 6 dB drop-off at about 96 Hz.

13. A sound reproduction system, comprising:

a plurality of loudspeakers arranged in a spaced array on opposite sides of a center point, said spaced array including an outermost pair of loudspeakers disposed at opposite ends of said array, each loudspeaker included in said outermost pair of loudspeakers being equally spaced apart from said center point, and at least one inner pair of loudspeakers spaced inwardly from said outermost pair of loudspeakers and positioned on opposite sides of said center point, each loudspeaker included in one of said at least one inner pairs of loudspeakers being equally spaced apart from said center point;

a low-pass filter having an output coupled to an input of each one of said outer pair of loudspeakers; and a band-pass filter corresponding to each one of said at least one inner pair of loudspeakers, each said band-pass filter having an output coupled to an input of each one of said corresponding inner pair of loudspeakers.

14. A sound reproduction system according to claim 13 and further comprising:

a first inner pair of loudspeakers, each spaced a first distance from said center point; and a first band-pass filter having an output coupled to an input of each one of said first inner pair of loudspeakers.

15. A sound reproduction system according to claim 14 wherein said low-pass filter has a high end frequency limit approximately equal to a low end frequency limit of said first band-pass filter.

16. A sound reproduction system according to claim 14 and further comprising:

a second inner pair of loudspeakers, each spaced a second distance from said center point, said second distance greater than said first distance; and a second band-pass filter having an output coupled to an input of each one of said second inner pair of loudspeakers.

17. A sound reproduction system according to claim 16 wherein said first band-pass filter has a low end frequency limit approximately equal to a high end frequency limit of said low-pass filter and a high end frequency limit approximately equal to a low end frequency limit of said second band-pass filter.

18. A sound reproduction system according to claim 13 wherein said spaced array is an essentially straight spaced array.

19. A sound reproduction system according to claim 18 wherein said essentially straight spaced array is orientated along a generally vertical axis.

20. A sound reproduction system according to claim 18 wherein said essentially straight spaced array is orientated along a generally horizontal axis.

21. A sound reproduction system, comprising:

a plurality of loudspeakers arranged in an essentially straight spaced array on opposite sides of a center point, said essentially straight spaced array including an outermost pair of loudspeakers disposed at opposite ends of said array, each loudspeaker included in said outermost pair of loudspeakers being equally spaced apart from said center point, and at least one inner pair of loudspeakers spaced inwardly from said outermost pair of loudspeakers and positioned on opposite sides of said center point, each loudspeaker included in one of said at least one inner pairs of loudspeakers being equally spaced apart from said center point;

a low-pass filter having an output coupled to an input of each one of said outer pair of loudspeakers; and a band-pass filter corresponding to each one of said at least one inner pair of loudspeakers, each said band-pass filter having an output coupled to an input of each one of said corresponding inner pair of loudspeakers;

wherein said essentially straight spaced array is orientated along a generally diagonal axis.

22. A sound reproduction system, comprising:

a first plurality of loudspeakers arranged in a first spaced array on opposite sides of a center point, said first spaced array including an outer pair of loudspeakers disposed at opposite ends of said first spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a second plurality of loudspeakers arranged in a second spaced array on opposite sides of said center point, said second spaced array including an outer pair of loudspeakers disposed at opposite ends of said second spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a low-pass filter having an output coupled to an input of each one of said outer pair of loudspeakers of said first spaced array and each one of said outer pair of loudspeakers of said second spaced array; and a band-pass filter having an output coupled to an input of each one of said inner pair of loudspeakers of said first spaced array and each one of said inner pair of loudspeakers of said second spaced array.

23. A sound reproduction system, comprising:

a first plurality of loudspeakers arranged in a first spaced array on opposite sides of a center point, said first spaced array including an outer pair of loudspeakers disposed at opposite ends of said first spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a second plurality of loudspeakers arranged in a second spaced array on opposite sides of said center point, said second spaced array including an outer pair of loudspeakers disposed at opposite ends of said second spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a low-pass filter having an output coupled to an input of each one of said outer pair of loudspeakers of said first spaced array and each one of said outer pair of loudspeakers of said second spaced array; and a band-pass filter having an output coupled to an input of each one of said inner pair of loudspeakers of said first spaced array and each one of said inner pair of loudspeakers of said second spaced array;

wherein said first spaced array is an essentially straight spaced array orientated along a generally vertical axis and said second spaced array is an essentially straight spaced array orientated along a generally horizontal axis.

24. A sound reproduction system, comprising:

a first plurality of loudspeakers arranged in a first spaced array on opposite sides of a center point, said first spaced array including an outer pair of loudspeakers disposed at opposite ends of said first spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a second plurality of loudspeakers arranged in a second spaced array on opposite sides of said center point, said second spaced array including an outer pair of loudspeakers disposed at opposite ends of said second spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a third plurality of loudspeakers arranged in a second spaced array on opposite sides of said center point, said third spaced array including an outer pair of loudspeakers disposed at opposite ends of said third spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a fourth plurality of loudspeakers arranged in a fourth spaced array on opposite sides of said center point, said fourth spaced array including an outer pair of loudspeakers disposed at opposite ends of said fourth spaced array, each loudspeaker included in said outer pair of loudspeakers being equally spaced apart from said center point, and an inner pair of loudspeakers spaced inwardly from said outer pair of loudspeakers and positioned on opposite sides of said center point, each loudspeaker included in said inner pair of loudspeakers being equally spaced apart from said center point;

a low-pass filter having an output coupled to an input of each one of said outer pair of loudspeakers of said first spaced array, each one of said outer pair of loudspeakers of said second spaced array, each one of said outer pair of loudspeakers of said third spaced array and each one of said outer pair of loudspeakers of said fourth spaced array;

a band-pass filter having an output coupled to an input of each one of said inner pair of loudspeakers of said first spaced array, each one of said inner pair of loudspeakers of said second spaced array, each one of said inner pair of loudspeakers of said third spaced array and each one of said inner pair of loudspeakers of said fourth spaced array;

wherein said first spaced array is an essentially straight spaced array orientated along a generally vertical axis, said second spaced array is an essentially straight spaced array orientated along a generally horizontal axis, said third spaced array is an essentially straight spaced array orientated along a first, generally diagonal, axis and said fourth spaced array is an essentially straight spaced array orientated along a second, generally diagonal, axis.

25. A sound reproduction system according to claim 1 wherein said low-pass filter and said first band-pass filter are configured to have a cross-over frequency of about 215/D, where D is the distance separating a first loudspeaker of said second pair of loudspeakers and a second loudspeaker of said second pair of loudspeakers.

26. A sound reproduction system according to claim 1 wherein said low-pass filter and said first band-pass filter are configured to have a cross-over frequency inversely proportional to the distance separating a first loudspeaker of said second pair of loudspeakers and a second loudspeaker of said second pair of loudspeakers.

27. A sound reproduction system according to claim 10 wherein said first band-pass filter and said second band-pass filter are configured to have a cross-over frequency of about 215/D, where D is the distance separating a first loudspeaker of said second pair of loudspeakers and a second loudspeaker of said first second of loudspeakers.

28. A sound reproduction system according to claim 10 wherein said first band-pass filter and said second band-pass filter are configured to have a cross-over frequency inversely proportional to the distance separating a first loudspeaker of said second pair of loudspeakers and a second loudspeaker of said second pair of loudspeakers.

29. A sound reproduction system according to claim 10 wherein said low-pass filter and said second band-pass filter are configured to have a cross-over frequency of about 215/D, where D is the distance separating a first loudspeaker of said third pair of loudspeakers and a second loudspeaker of said third pair of loudspeakers.

30. A sound reproduction system according to claim 29 wherein said first band-pass filter and said second band-pass filter are configured to have a cross-over frequency of about 215/D, where D is the distance separating a first loudspeaker of said second pair of loudspeakers and a second loudspeaker of said first second of loudspeakers.

31. A sound reproduction system according to claim 10 wherein said low-pass filter and said second band-pass filter are configured to have a cross-over frequency inversely proportional to the distance separating a first loudspeaker of said third pair of loudspeakers and a second loudspeaker of said third pair of loudspeakers.

32. A sound reproduction system according to claim 31 wherein said first band-pass filter and said second band-pass filter are configured to have a cross-over frequency inversely proportional to the distance separating a first loudspeaker of said second pair of loudspeakers and a second loudspeaker of said second pair of loudspeakers.

33. A sound reproduction system according to claim 14 wherein said low-pass filter and said first band-pass filter are configured to have a cross-over frequency of about 215/D, where D is the distance separating a first loudspeaker of said first inner pair of loudspeakers and a second loudspeaker of said first inner pair of loudspeakers.

34. A sound reproduction system according to claim 14 wherein said low-pass filter and said first band-pass filter are configured to have a cross-over frequency inversely proportional to the distance separating a first loudspeaker of said first inner pair of loudspeakers and a second loudspeaker of said first inner pair of loudspeakers.

35. A sound reproduction system according to claim 16 wherein said first band-pass filter and said second band-pass filter are configured to have a cross-over frequency of about 215/D, where D is the distance separating a first loudspeaker of said first inner pair of loudspeakers and a second loudspeaker of said first inner pair of loudspeakers.

36. A sound reproduction system according to claim 16 wherein said first band-pass filter and said second band-pass filter are configured to have a cross-over frequency inversely proportional to the distance separating a first loudspeaker of said first inner pair of loudspeakers and a second loudspeaker of said first inner pair of loudspeakers.

37. A sound reproduction system according to claim 16 wherein said low-pass filter and said second band-pass filter are configured to have a cross-over frequency of about 215/D, where D is the distance separating a first loudspeaker of said second inner pair of loudspeakers and a second loudspeaker of said second inner pair of loudspeakers.

38. A sound reproduction system according to claim 37 wherein said first band-pass filter and said second band-pass filter are configured to have a cross-over frequency of about 215/D, where D is the distance separating a first loudspeaker of said first inner pair of loudspeakers and a second loudspeaker of said first inner pair of loudspeakers.

39. A sound reproduction system according to claim 16 wherein said low-pass filter and said second band-pass filter are configured to have a cross-over frequency inversely proportional to the distance separating a first loudspeaker of said second inner pair of loudspeakers and a second loudspeaker of said second inner pair of loudspeakers.

40. A sound reproduction system according to claim 39 wherein said first band-pass filter and said second band-pass filter are configured to have a cross-over frequency inversely proportional to the distance separating a first loudspeaker of said first inner pair of loudspeakers and a second loudspeaker of said first inner pair of loudspeakers.

* * * * *